US005928057A

United States Patent [19]

Teczynski

[11] Patent Number: 5,928,057

[45] Date of Patent: Jul. 27, 1999

[54] RATTLE

[76] Inventor: Stefan Teczynski, Suite 310—4960 Bennett Street, Burnaby, British Columbia, Canada, V5H 2G9

[21] Appl. No.: 08/856,765

[22] Filed: May 15, 1997

[51] Int. Cl.[6] ..... A63H 5/00

[52] U.S. Cl. ..... 446/420; 446/265

[58] Field of Search ..... 446/420, 242, 446/265, 266

[56] References Cited

U.S. PATENT DOCUMENTS

| | | | |
|---|---|---|---|
| 438,489 | 10/1890 | Pringle | 446/265 X |
| 1,374,644 | 4/1921 | Folkush | 446/420 |
| 5,190,491 | 3/1993 | Connelly | 446/242 |

FOREIGN PATENT DOCUMENTS

| | | | |
|---|---|---|---|
| 327040 | 10/1920 | Germany | 446/420 |

*Primary Examiner*—Robert A. Hafer
*Assistant Examiner*—Jeffrey D. Carlson

[57] ABSTRACT

The invention is a rattle particularly for use at sporting events to generate an interesting noise. The rattle is preferably manufactured by plastic injection moulding and has two components only, namely a handle and a rotor journalled for relative rotation therebetween. The handle has a grip portion, and a toothed portion remote from the grip portion and preferably the toothed portion is manufactured by moulding integrally with the grip portion. The rotor has at least one vane adapted to sweep the toothed portion as the rotor rotates relative thereto and is assembled onto the handle by passing the toothed portion axially. A retainer retains the rotor and handle together while permitting said relative rotation. Preferably, the toothed portion has two sets of teeth and the rotor has twin vanes to sweep respective teeth.

22 Claims, 3 Drawing Sheets

RATTLE

BACKGROUND OF THE INVENTION

The invention relates to a rattle or noise maker, particularly for use by spectators at sporting events.

At sporting events, exuberant spectators express their enthusiasm by cheering, clapping and/or making loud noises with many different types of noise makers such as whistles, horns etc. A common type of noisemaker in Europe is a rotatable rattle which has a handle for gripping by the operator and a rotor which can be made to rotate about the handle by moving the handle in small circles. The handle has a toothed portion connected thereto, and the rotor is journalled on the handle and has a vane which sweeps the toothed portion as the rotor rotates so as to generate a harsh rattling noise. Rattles of this type are commonly made from several pieces of wood which require careful cutting followed by careful assembly. To the inventor's knowledge, a simplest, least costly rattle has a single set of teeth secured to a handle, and an integral rotor and vane, which requires a minimum of three separate parts which are assembled, and when so assembled cannot be separated easily. Because the parts are subjected to some considerable forces during use, a relatively high quality wood must be used and the parts must be fabricated accurately. These strict requirements tend to increase the cost of the item and any attempts to reduce the cost by reducing the quality of wood and manufacturing results in inferior performance and/or a relatively short life of the rattle.

While the least costly rattle has a single toothed portion and a single vane, an improved noise can be generated by providing at least two vanes which engage one or two sets of teeth in the toothed portion in such a way that an impact generated by one vane is followed very closely by an impact generated from the other vane. Some twin vane rattles produce a complex noise of different tones which is more interesting than the single vane rattle, but these necessarily require a more complex structure, thus resulting in a higher cost.

SUMMARY OF THE INVENTION

The invention reduces the difficulties and disadvantages of the prior art by providing a rattle which is best manufactured by plastic injection moulding using tough synthetic resins, and has been designed for manufacturing simplicity so that only two separate components are required. These components can be fabricated from injection dies relatively easily, each component being integral, that is manufactured in one piece. The rattle can be assembled quickly using a short simple linear movement, and when so assembled further work is not required and the components cannot be easily separated. To improve noise generation, preferably two vanes are used which sweep the toothed portion in such a way that an impact generated by one vane is followed immediately by an impact generated by the other vane in a manner similar to prior art twin vane noise rattles. However, in contrast to the prior art, the use of two vanes in the present invention does not increase the number of separate parts and has an essentially negligible effect on manufacturing costs of the product.

A rattle according to the invention comprises a handle and a rotor. The handle has a grip portion for gripping by an operator, and a toothed portion remote from the grip portion. The toothed portion is fixed relative to the handle and disposed concentrically about an axis of rotation of the rattle. The rotor is journalled on the handle to rotate about the axis of rotation and has at least one vane adapted to sweep the toothed portion as the rotor rotates relative thereto. The rattle is assembled by axial movement between the rotor and the handle which then retains the rotor and handle together while permitting said relative rotation therebetween.

Preferably, the toothed portion is moulded integrally with the handle and has teeth extending from a theoretical surface of revolution centred on the axis of rotation. The theoretical surface of revolution can be a parallel-sided cylinder and the teeth extend radially outwardly from the handle. Alternatively, the surface of revolution can be an annulus in a plane disposed perpendicularly to the axis of rotation and the teeth extend axially outwardly from the handle.

The rotor and handle are retained together by a retainer which comprises a movable shoulder and a fixed shoulder, the movable shoulder being adapted to deflect resiliently when exposed to force which occurs when the rotor is being assembled onto the handle by said axial displacement along the axis of rotation. The movable shoulder engages the fixed shoulder when the rattle is assembled to restrict disassembly.

A detailed disclosure following, related to drawings, describes a preferred embodiment of the invention which is capable of expression in structure other than that particularly described and illustrated.

DETAILED DESCRIPTION

Figure 1:
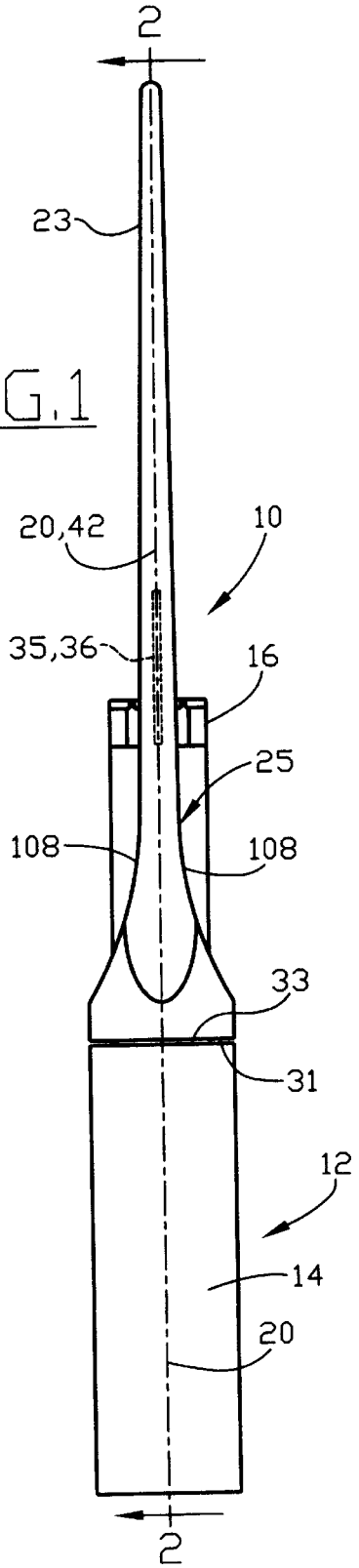
FIG. 1 is a front elevation of a rattle according to the invention.
Figure 2:
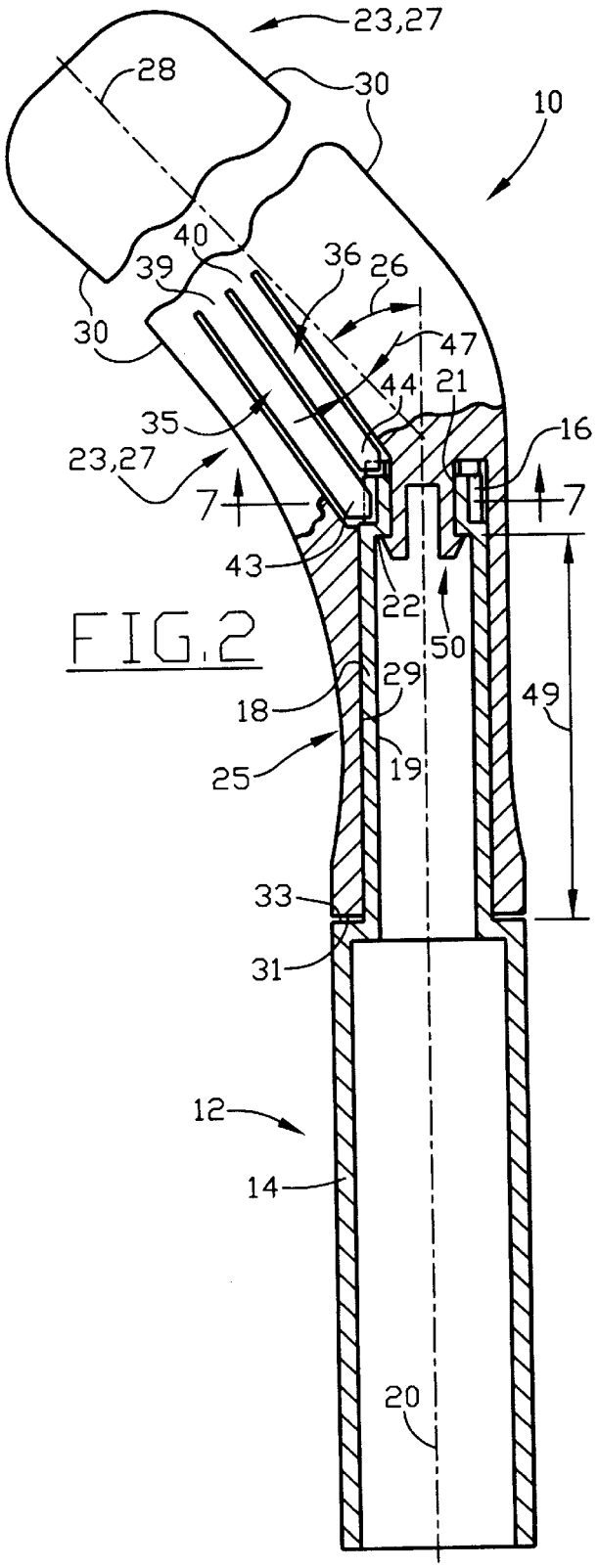
FIG. 2 is a simplified, fragmented, side elevation of the rattle which is partially sectioned on line 2—2 of FIG. 1 to show internal detail.

FIGS. 1 and 2

A rattle 10 according to the invention has a handle 12 having a grip portion 14 for gripping by an operator at one end of the handle, and a toothed portion 16 disposed at an opposite end of the handle, i.e. remotely from the grip portion. The handle 12 has a hollow cylindrical journalling portion 18 with an inner bore 19, both of which are concentric with an axis of rotation 20 extending longitudinally along the handle, and are disposed between the toothed portion 16 and the grip portion 14. The toothed portion 16 has an outer bore 21 which is smaller than the inner bore 19, and is concentric with and separated from the inner bore 19 by an annular inner shoulder 22.

The rattle 10 also includes a rotor 23 which has a body portion 25 and a blade portion 27. The body portion is concentric with the axis of rotation and has a body bore 29 which is a snug fit on the cylindrical journalling portion 18 so as to journal the rotor on the handle to rotate about the axis of rotation. The blade portion has generally parallel elongated side edges 30 and a generally rectangular end edge so as to resemble a blade of a conventional hockey stick. The blade portion 27 has a main blade axis 28 which intersects the axis of rotation 20 of the handle at an angle 26 which is about 45 degrees similarly to a hockey blade, but can be between about 30 and 90 degrees if other appearances are required. The body portion 25 has an end portion which has an annular end face 31 located closely adjacent a complementary outer shoulder 33 of the grip portion 14 which separates the grip portion from the journalling portion. Preferably the grip portion 14 has a diameter generally equal to the end portion of the body portion 25 to provide a smooth transition there between, so as to resemble the transition between a conventional hockey stick blade and associated hockey stick handle.

The rotor 23 has first and second vanes 35 and 36 which have proximal ends 39 and 40 which are integral with the blade portion 27, and free distal ends 43 and 44 projecting from the ends 39 and 40 to be adjacent the toothed portion 16 to cooperate therewith as will be described also with reference to FIGS. 3 and 6. The vanes of the rotor are generally parallel to and disposed within a blade plane 42 of the blade portion 27, and are formed integrally with the blade portion and are thinner than the blade portion (See FIG. 7). Thus, for a blade portion 27 having a nominal thickness of approximately 8 mm, the vanes would have a root thickness generally adjacent the proximal ends of approximately 2 mm, and a tip thickness of about 1 mm. The vanes are within the blade plane 42 which intersects the axis of rotation 20, although this is not critical because, similarly to conventional rattles, the vanes could be inclined generally tangentially to the axis of rotation as will be described.

The vanes 35 and 36 are inclined at a shallow angle 47 to the axis 28 when viewed perpendicularly to the plane 42 of the blade portion, which angle can be between about 15 degrees and 0 degrees, although this is not critical. The rattle also includes a retainer 50 to retain the rotor and handle together while permitting said relative rotation therebetween. The retainer has complementary portions integral with the handle and rotor and is described in greater detail with reference to FIGS. 6 and 7.

Preferably, the handle 12 and the rotor 23 are injection moulded using tough synthetic resins, and thus the toothed portion 16 and the vanes 35 and 36 are moulded integrally with the handle and the rotor respectively, thus simplifying manufacturing and assembly.

Figure 3:
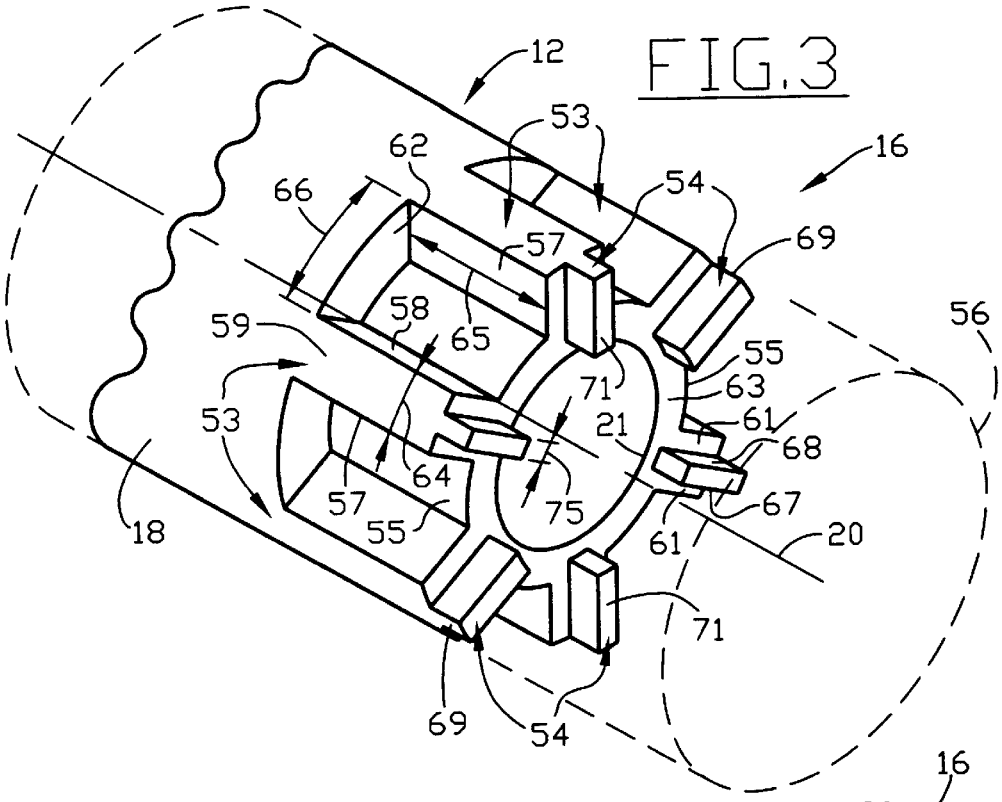
FIG. 3 is a fragmented perspective of a toothed portion at one end of a handle of the rattle.
Figure 5:
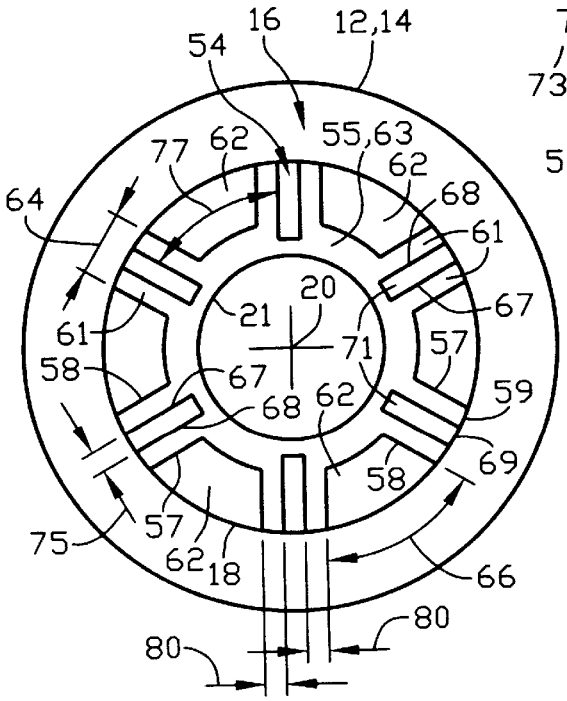
FIG. 5 is a simplified top plan of the handle showing the toothed portion.
Figure 4:
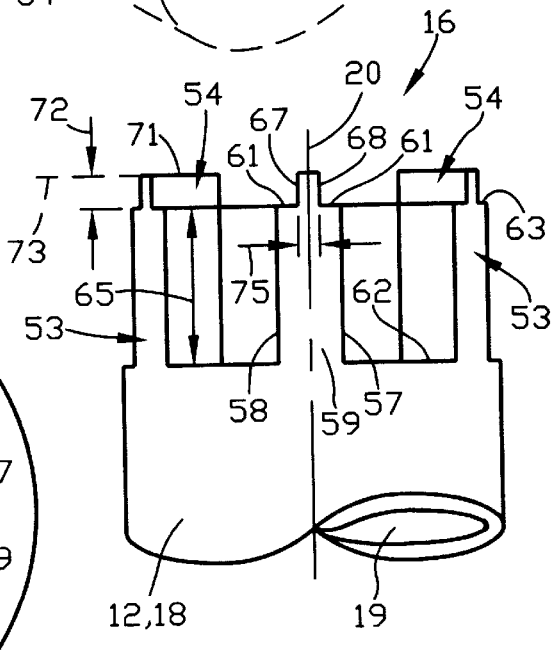
FIG. 4 is a fragmented side elevation of the toothed portion.

FIGS. 3 Through 5

The toothed portion 16 is symmetrical about the axis of rotation 20 and has first and second sets of teeth 53 and 54 respectively, the first set being located between the second set and the journalling portion 18. The first set of teeth 53 comprises a plurality of similar teeth spaced circumferentially about a first surface of revolution, which is a parallel-sided cylinder or annulus 55 concentric with the axis of rotation 20. The teeth 53 extend radially outwardly from the annulus 55 (i.e. the handle 12) to respective tooth tips which are disposed within a theoretical cylindrical surface 56 (broken outline in FIG. 3) which is an envelope containing the journalling portion 18 of the handle. It can be seen that each tooth 53 of the first set has a pair of plane parallel side faces 57 and 58 interconnected by a curved outer face 59 which is a portion of the theoretical cylindrical surface 56. Each tooth 53 also has a pair of similar co-planar end faces 61 which are disposed perpendicularly to the axis 20, the side faces 57 and 58, and the outer face 59, and are also co-planar with an annular distal end face 63 of the handle which encircles the outer bore 21. The handle also has a plurality of circumferentially spaced co-planar arcuate proximal end faces 62, each of which extends between a pair of opposed side faces 57 and 58 of two adjacent teeth 53. It can be seen that axial spacing between a proximal end face 62 and the distal end face 63 of a particular tooth defines axial length 65 of the first teeth 53, and tangential spacing between the side faces 57 and 58 of a particular first tooth 53 defines width 64 of the first tooth. As best seen in FIG. 5, the width 64 of the first tooth is generally equal to width of an outermost inter-tooth spacing or pitch 66 between oppositely facing side faces 57 and 58 of two adjacent teeth. This provides first teeth of adequate width and an adequate number of teeth to generate a reasonable noise at a reasonable speed of rotation of the rotor as will be explained.

The second set of teeth 54 is disposed on a second surface of revolution, i.e. an annulus disposed within a diametrical plane containing the annular distal end face 63, which is clearly disposed perpendicularly to the axis of rotation 20. Each tooth 54 extends axially outwardly from the handle and from a respective first tooth 53, that is each second tooth 54 extends perpendicularly to the respective pairs of end faces 61 of a respective first tooth 53. Each tooth 54 has plane parallel side faces 67 and 68, a curved outer face 69 and a flat end face 71. The outer face 69 is a portion of the theoretical cylindrical surface 56 and thus is aligned with the outer face 59 of the respective first teeth 53. Each end face 71 is within a theoretical annular plane 73 parallel to and spaced axially from the annular distal end face 63 by depth 72 of the second teeth 54. It can be seen that each tooth 53 and 54 provide a combination of related teeth which have different thicknesses.

Spacing between side faces 67 and 68 of a particular second tooth defines width 75 of the second tooth which is clearly less than the width 64 of the first teeth. Preferably, the second teeth are located symmetrically with respect to the first teeth so that the end faces 61 of the first teeth disposed on opposite sides of the respective second teeth have equal widths. A spacing 77 between oppositely facing side faces 67 and 68 of adjacent second teeth 54 defines inter-tooth spacing or pitch of the second teeth, which is considerably greater than the spacing 66 between adjacent teeth or pitch of the first teeth 53.

FIGS. 1, 2, 6 and 7

Figure 7:
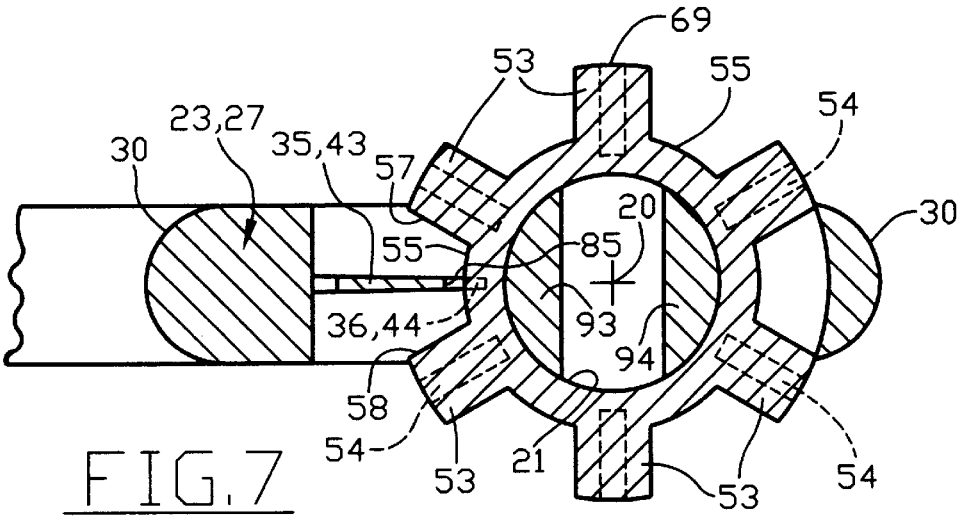
FIG. 7 is a simplified fragmented cross section of the assembled rotor and handle as seen from Line 7—7 of FIG. 2, showing cooperating portions of a retainer.
Figure 6:
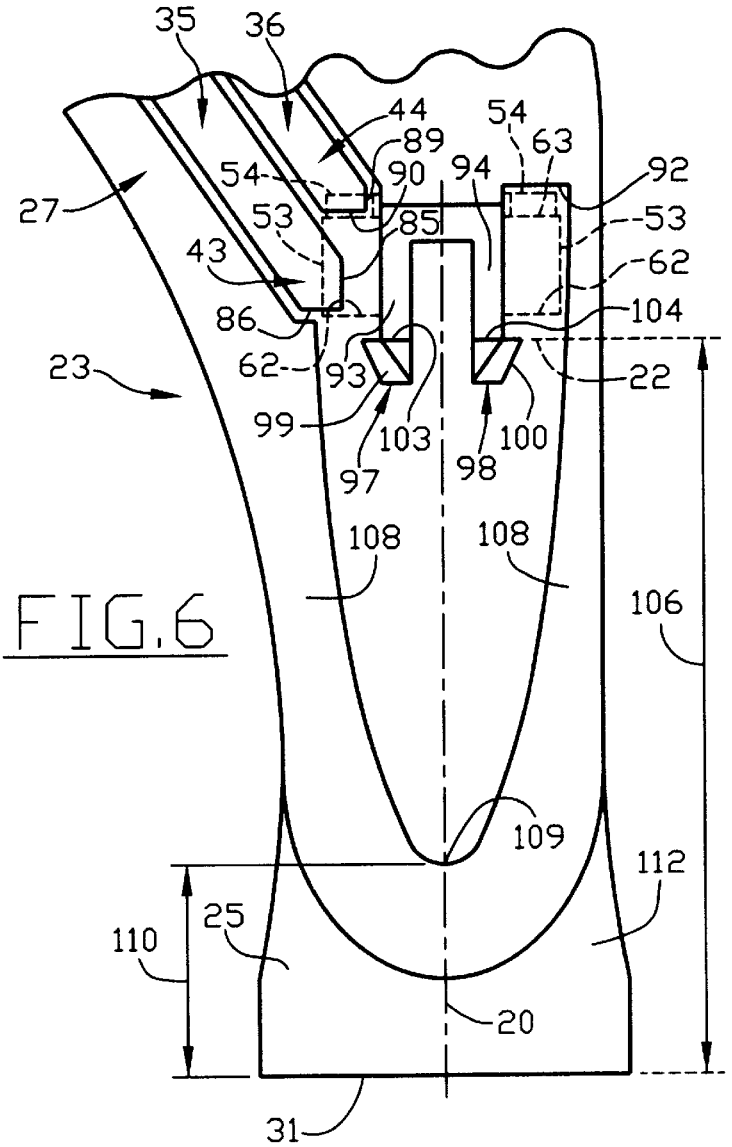
FIG. 6 is a fragmented side elevation of a portion of a rotor of the rattle, also showing relative positions of some teeth in broken outline.

Referring to FIGS. 6 and 7, the distal end 43 of the first vane 35 has axial and radial edges 85 and 86 respectively which are disposed perpendicularly to each other and generally parallel to the axis 20 and the faces 62 respectively, the faces 62 being shown in broken outline in FIG. 6. The end 43 has a relatively narrow width, see FIG. 7, so as to be received between the oppositely facing side faces 57 and 58 of adjacent first teeth 53. In FIG. 6, relative positions of the teeth 53 and 54 are shown in broken outline. To avoid interference, the edges 85 and 86 of the end 43 are spaced from the side face of the annulus 55 and the arcuate co-planar proximal end faces 62 of the handle respectively, as shown in FIGS. 6 and 7. The axial edge 85 is positioned so as to be generally aligned with the side faces 57 and 58 of the teeth 53 so as to strike the appropriate side faces of the teeth when there is relative rotation between the rotor and the handle.

The distal end 44 of the second vane 36 has axial and radial edges 89 and 90 which are similarly disposed perpendicularly to each other and parallel to the axis 20 and distal end face 63 respectively. The end 44 is relatively thin so as to be received between oppositely facing side faces 67 and 68 of the second teeth 54. The radial edge 90 of the distal end 44 is positioned to be between the end faces 61 of the first teeth 53 and the end faces 71 of the second teeth 54 (FIG. 4) so as impinge side faces of the second teeth during relative rotation between the rotor and the handle. Clearance is provided between the radial edge 90 and the distal end face 63 of the annulus so as to prevent interference therewith. As seen in FIG. 6, the rotor has a clearance portion 92 spaced from the axis 20 and located on an opposite side from the vanes to prevent interference with the toothed portion as the rotor rotates relative to the handle.

The retainer 50 of the rotor has a pair of axially aligned parallel fingers 93 and 94 which extend axially from and are disposed symmetrically about a mid-position of the rotor which is adjacent an intersection of the axis 20 with the blade portion 27. The fingers extend to distal end portions which carry generally triangular-shaped projections 97 and 98 which have obliquely inclined, outwardly facing cam faces 99 and 100 respectively. The projections 97 and 98 have co-planar upwardly facing rear faces 103 and 104 respectively which extend perpendicularly from the fingers and are within a plane generally perpendicular to the axis 20. Each projection has a lateral width greater than width of the finger portion to provide rear faces or shoulders 103 and 104 which are spaced from the end face 31 of the rotor body portion 25 by an axial spacing 106 which is critical for reasons as follows.

Referring to FIG. 2, axial spacing 49 between the outer shoulder 33 of the grip portion 14 and the annular inner shoulder 22 between the inner and outer bores 19 and 21 is equal approximately to the spacing 106. When the rotor is assembled onto the handle, the rear faces 103 and 104 of the projections engage the annular inner shoulder 22 between the inner and outer bores 19 and 21, and the annular end face 31 of the rotor engages the outer shoulder 33 of the grip portion. Relative spacing between the shoulders 22, and the rear faces 103 and 104, and between the end face 31 and shoulder 33, are selected to essentially prevent excessive axial movement between the rotor and the handle, yet permitting smooth rotation therebetween. Clearly, locating the rotor with respect to the handle axially prevents unintentional interference between the clearance portion 92 and the toothed portion 16. As seen in FIGS. 1 and 6, the body portion 25 has diametrically opposed clearance portions 108 to reduce surface area between the journalling portion 18 and the body bore 29 to reduce friction during rotation. The clearance portion 108 has a lowermost margin 109 spaced from the end face 31 of the rotor by a spacing 110. This spacing provides a distal bearing portion 112 in which the body bore 29 is defined in part by a continuously extending annular sidewall to provide a sturdy mounting for the rotor.

OPERATION

As stated previously, the handle 12 and the rotor 23 are each manufactured as separate injection moulded one-piece components and these two components form the complete rattle, thus simplifying manufacturing. The two components are easily assembled by inserting the toothed portion 16 axially into the body bore 29 of the body portion 25 of the rotor, and passing the journalling portion 18 into the body bore 29 until the upper edge portion of the outer bore 21 contacts the obliquely inclined cam faces 99 and 100 of the projections at outer ends of the fingers. To enable this type of simple assembly, the body bore 29 has a diameter larger than the diameter of the toothed portion 16. Resistance to axial motion is overcome by increasing the axial force between the rotor and the handle, which forces the inner edge of the distal end face 63 against the cam faces 99 and 100 of the projections. The angles of the faces 99 and 100 generate inwards forces on the fingers which deflect resiliently inwardly, permitting the side walls of the outer bore 21 to pass over the projections 97 and 98. Axial movement is continued until the projections 97 and 98 pass completely through the outer bore 21, at which time the fingers resiliently move outwardly so that the rear faces 103 and 104 of the projections come to engage the annular inner shoulder 22 of the handle to provide a first set of axial datum surfaces for the rotor and handle. In this position the end face 31 of the rotor engages the outer shoulder 33 to provide an opposite second set of axial datum surfaces for the rotor and handle. These two pairs of engaged datum surfaces securely locate the rotor on the handle and prevent separation of the handle from the rotor unless a special tool is used which moves the fingers inwardly to permit reversal of the above assembly.

It can be seen that the toothed portion 16 has a center bore, namely the outer bore 21, which is disposed concentrically with respect to the axis of rotation, the bore having a sidewall with a fixed shoulder extending therearound, namely the inner shoulder 22, which provides the annular datum surface serving as a fixed shoulder for the handle. Similarly, the elongated fingers 93 and 94 with the projections which provide the rear faces 103 and 104 serve as movable shoulders associated with the rotor so as to extend therefrom. Thus, each movable shoulder is adapted to deflect resiliently when exposed to force which occurs when the rotor is being assembled onto the handle by axial displacement along the axis of rotation. When the rattle is assembled the movable shoulders engages the fixed shoulder, and the shoulder 33 of the handle engages the end face 31 of the rotor to serve as thrust bearings. Clearly, both the radial bearings and axial thrust bearings are relatively large to reduce wear.

The operation of the rattle is generally similar to that of a conventional rattle and the rotor can be made to swing about the handle by forcing the handle in a small circular movement. As the rotor rotates about the handle, the first set of teeth 53 are swept by the first vane 35, and the second set of teeth 54 are swept by the second vane 36. The vanes are co-planar with each other, but contact faces or edges of the second set of teeth are phased angularly or circumferentially with respect to contact faces or edges of the first set of teeth as exemplified by angular phase differences 80 shown in FIG. 5. The phase differences between the two sets of teeth ensure the vanes do not engage or disengage each combination of teeth 53 and 54 simultaneously. Thus, as the rotor rotates, the first vane contacts the first tooth, followed rapidly by contact between the second vane and the second tooth. This in turn is followed by separation of the second vane from the second tooth, and rapidly by separation of the first vane from the first tooth. Impacts between the vanes and the teeth generate several tones which provide an interesting noise when compared with a single vane contacting a single set of teeth.

ALTERNATIVES

The invention as disclosed has two generally similar and parallel vanes, namely a second vane disposed adjacent and generally parallel to the first vane. The toothed portion has the first and second sets of teeth which extend from a theoretical surface of revolution bounded by a non-linear profile, and are adapted to be swept by the first and second vanes respectively. In a simplified embodiment of the invention a single set of teeth can be swept by a single vane, the single set of teeth being disposed on a surface of revolution which can be a cylinder similar to the first set of teeth, an annulus similar to the second set of teeth, or disposed on a bevel or any other theoretical surface of revolution centred on the axis 20 and disposed at any angle between the surfaces of revolution as disclosed. In addition, clearly a third set of teeth could be provided, with a third vane contacting the third of set of teeth which could be located relatively to the first and second set of teeth to provide a more distinctive tone that is generated by the spacing between side faces of the first and second sets of teeth as described herein.

In the embodiment disclosed, the vanes 35 and 36 are parallel to each other and disposed radially with respect to the axis of rotation, that is, if projected, axes of the vanes would intercept the axis of rotation 20. Similarly to some prior art rattles, in an alternative one or both of the vanes could be inclined tangentially to the axis so as not to intersect the axis of rotation as to provide a difference characteristic noise when the rattle is rotated in opposite directions. For more tone variations, thickness and/or length of each vane could differ considerably from each other.

Also, the teeth 53 and 54 are shown with flat side faces disposed parallel to respective radii of the handle. Clearly, shape of tooth faces or profile of the teeth could be changed, e.g. to involute form etc.

What is claimed is:

1. A rattle comprising:

(a) a handle having a grip portion for gripping by an operator, a toothed portion remote from the grip portion, and a journalling portion, the toothed portion and the journalling portion being integral with the handle so as to be fixed relative to the handle and disposed concentrically about an axis of rotation of the rattle, and (b) a one-piece rotor journalled on the journalling portion of the handle to rotate about the axis of rotation, the rotor having at least one vane adapted to sweep the toothed portion as the rotor rotates relative thereto, the rotor having a body portion with a body bore which is defined in part by a continuously extending annular sidewall which has a diameter larger than the diameter of the toothed portion so that the rattle can be assembled by axial movement in one direction between the rotor and the handle to retain the rotor and the handle together while permitting said relative rotation therebetween.

2. A rattle as claimed in claim 1, in which:

(a) the toothed portion has teeth extending from a theoretical surface of revolution centered on the axis of rotation.

3. A rattle as claimed in claim 2, in which:

(a) the theoretical surface of revolution is a parallel-sided cylinder concentric with the axis of rotation, and (b) the teeth extend radially outwardly from the handle.

4. A rattle as claimed in claim 2, in which:

(a) the surface of revolution is an annulus in a plane disposed perpendicularly to the axis of rotation, and (b) the teeth extend axially outwardly from the handle.

5. A rattle as claimed in claim 2, in which:

(a) the theoretical surface of revolution is bounded by a non-linear profile to define first and second surfaces of revolution.

6. A rattle as claimed in claim 5, in which:

(a) the toothed portion has first and second sets of teeth, (b) the first set of teeth are disposed on the first surface of revolution which is a parallel-sided cylinder concentric with the axis of rotation, and (c) the second set of teeth are disposed on the second surface of revolution which is an annulus in a plane disposed perpendicularly to the axis of rotation.

7. A rattle as claimed in claim 6, in which:

(a) the rotor has a second vane disposed generally adjacent and parallel to the first vane, and (b) contact edges of the second set of teeth are phased circumferentially apart with respect to contact edges of the first set of teeth so that the first and second vanes do not engage or disengage the teeth simultaneously.

8. A rattle as claimed in claim 6, in which:

(a) the teeth of the first set of teeth extend radially outwardly from the handle, and (b) the teeth of the second set of teeth extend axially outwardly from the handle.

9. A rattle as claimed in claim 1, in which:

(a) the journalling portion is disposed between the toothed portion and the grip portion.

10. A rattle as claimed in claim 9, in which:

(a) the toothed portion has teeth extending generally radially outwardly to tooth tips thereof, the tooth tips being disposed within a theoretical cylindrical surface containing the journalling portion, the theoretical surface of revolution being a parallel-sided cylinder concentric with the axis of rotation.

11. A rattle as claimed in claim 1, in which:

(a) the body portion of the rotor is concentric with the axis of rotation, and the rotor has a blade portion having a main blade axis which intersects the axis of rotation, and (b) the journalling portion is cylindrical to journal the rotor thereon.

12. A rattle as claimed in claim 11, in which:

(a) the vane of the rotor is disposed within a plane of the blade portion and is formed of the material thinner than the blade portion.

13. A rattle as claimed in claim 12, further including:

(a) a second vane disposed adjacent and generally parallel to the first vane, and (b) the toothed portion has first and second sets of teeth adapted to be swept by the first and second vanes respectively.

14. A rattle as claimed in claim 12, in which:

(a) the vane is disposed generally parallel to the plane of the blade portion.

15. A rattle as claimed in claim 1, in which:

(a) the body portion has clearance portions to reduce surface area between the journalling portion and the body bore to reduce friction during rotation.

16. A rattle as claimed in claim 11, in which:

(a) the blade portion of the rotor resembles a blade portion of a hockey stick, and (b) the body portion of the rotor and the handle resemble a portion of a handle of the hockey stick.

17. A rattle as claimed in claim 1, in which the rotor and the handle are retained together by a retainer which comprises:

(a) a movable shoulder and a fixed shoulder, the movable shoulder being adapted to deflect resiliently when exposed to force which occurs when the rotor is being assembled onto the handle by said axial displacement along the axis of rotation, the movable shoulder engaging the fixed shoulder when the rattle is assembled to restrict disassembly.

18. A rattle as claimed in claim 17, in which:

(a) the handle having the fixed shoulder, and (b) the rotor having the movable shoulder extending therefrom, the movable shoulder being deflected when forcing the rotor axially onto the handle.

19. A rattle as claimed in claim 18, in which:

(a) the toothed portion has a central bore disposed concentrically with respect to the axis of rotation, the bore having a side wall with fixed shoulder extending therearound to provide an annular surface, and (b) the movable shoulder portion comprises at least one elongated finger extending axially from the rotor and having a projection at a distal end thereof, the projection having a lateral width greater than width of the finger to define a rear facing shoulder thereon, the projection also having an obliquely inclined cam surface adapted to contact the handle to deflect the finger in such direction as to permit the finger to enter the central bore of the handle to permit engagement between the fixed shoulder of the toothed portion, and the rear facing shoulder of the projection.

20. A rattle comprising:

(a) a handle having a grip portion for gripping by an operator, and a toothed portion remote from the grip portion, the toothed portion being moulded integrally with the handle so as to be fixed relative to the handle, the toothed portion being disposed concentrically about an axis of rotation of the rattle and having teeth extending from a theoretical surface of revolution centered on the axis of rotation, the theoretical surface of revolution being an annulus in a plane disposed perpendicularly to the axis of rotation, the teeth extending axially outwardly from the handle, and (b) a rotor journalled on the handle to rotate about the axis of rotation, the rotor having at least one vane adapted to sweep the toothed portion as the rotor rotates relative thereto, the rattle being assembled by axial movement between the rotor and the handle to retain the rotor and handle together while permitting said relative rotation therebetween.

21. A rattle comprising:

(a) a handle having a grip portion for gripping by an operator, and a toothed portion remote from the grip portion, the toothed portion being moulded integrally with the handle so as to be fixed relative to the handle, the toothed portion being disposed concentrically about an axis of rotation of the rattle and having teeth extending from a theoretical surface of revolution centered on the axis of rotation, the theoretical surface of revolution being bounded by a non-linear profile to define first and second surfaces of revolution; the toothed portion having first and second sets of teeth, the first set of teeth extending radially outwardly from the handle and being disposed on the first surface of revolution which is a parallel-sided cylinder concentric with the axis of rotation, and the second set of teeth extending axially outwardly from the handle and being disposed on the second surface of revolution which is an annulus in a plane disposed perpendicularly to the axis of rotation, and (b) a rotor journalled on the handle to rotate about the axis of rotation, the rotor having first and second vanes adapted to sweep the first and second sets of teeth respectively as the rotor rotates relative thereto, the rattle being assembled by axial movement between the rotor and the handle to retain the rotor and the handle together while permitting said relative rotation therebetween.

22. A rattle comprising:

(a) a handle having a grip portion for gripping by an operator, and a toothed portion remote from the grip portion, the toothed portion being fixed relative to the handle and disposed concentrically about an axis of rotation of the rattle, the handle also having a central bore disposed concentrically with respect to the axis of rotation, the central bore having a sidewall with a fixed shoulder extending therearound to provide an annular surface, and (b) a rotor journalled on the handle to rotate about the axis of rotation, the rotor having at least one vane adapted to sweep the toothed portion as the rotor rotates relative thereto, the rotor having a moveable shoulder portion extending therefrom, the moveable shoulder portion comprising at least one elongated finger extending axially from the rotor and having a projection at a distal end thereof, the projection having a lateral width greater than width of the finger to define a rear facing shoulder thereon, the projection also having an obliquely inclined cam surface adapted to contact the handle to deflect the finger in such direction as to permit the finger to enter the central bore of the handle to permit engagement between the fixed shoulder of the toothed portion and the rear facing shoulder of the projection, so that the rattle can be assembled by moving the rotor axially onto the handle along the axis of rotation so that the finger of the moveable shoulder portion is deflected and eventually engages the fixed shoulder when the rattle is assembled to retain the rotor and handle together while permitting said relative rotation therebetween.

* * * * *